United States Patent [19]

Tsen et al.

[11] 4,139,756

[45] Feb. 13, 1979

[54] PUSH BUTTON SWITCH WITH SECONDARY PUSH BUTTON

[75] Inventors: John B. Tsen; David A. Reel, both of Louisville, Ky.

[73] Assignee: General Electric Company, Louisville, Ky.

[21] Appl. No.: 756,496

[22] Filed: Jan. 3, 1977

[51] Int. Cl.[2] ..... H01H 3/20; H01H 3/12

[52] U.S. Cl. ..... 200/330; 200/331; 200/340

[58] Field of Search ..... 200/330, 331, 335, 339, 200/340

[56] References Cited

U.S. PATENT DOCUMENTS

| | | | |
|---|---|---|---|
| 3,566,065 | 2/1971 | Davis | 200/330 |
| 3,689,724 | 9/1972 | Labude et al. | 200/330 |
| 3,916,150 | 10/1975 | Abernethy et al. | 200/340 |
| 3,931,488 | 1/1976 | Beyer | 200/331 |

OTHER PUBLICATIONS

IBM Technical Disclosure Bulletin, vol. 16, No. 5, Oct. 1973, Nonteasable Switch Actuator, J. L. Yarborough.

*Primary Examiner*—William Price
*Assistant Examiner*—Steven M. Pollard
*Attorney, Agent, or Firm*—Radford M. Reams

[57] ABSTRACT

A push button switch is supported in a mounting plate. A control panel is positioned in front of the mounting plate and spaced therefrom. A secondary push button of decorative appearance is positioned in an opening in the control panel to be offset from the centerline of the first push button. The secondary push button has a flange extension on one side thereof behind the control panel to serve as a fulcrum means for an improved motion of the secondary button. A spacer spring is attached to the mounting plate to bear against the inner end of the secondary button.

2 Claims, 3 Drawing Figures

PUSH BUTTON SWITCH WITH SECONDARY PUSH BUTTON

BACKGROUND OF THE INVENTION (1) Field Of The Invention

This invention relates to a push button switch assembly, and particularly to an assembly with a secondary push button to be positioned in a control panel that overlies the switch.

(2) Description Of The Prior Art

The present invention is used in the control panel of an electric range, and particularly a high-low range having a lower oven provided with a cooktop mounted over the top of the oven. In addition, there is a microwave oven positioned at eye-level over the cooktop. At the side of the microwave oven is a single large control panel which supports control components for all three appliances; the two ovens and the cooktop. Hence, it will be appreciated that such a control panel is short of available space as it may include a selector switch, an oven thermostat and a clock-timer for the lower oven, also an infinite heat switch for each of the four surface heating units of the cooktop, as well as a timer and temperature control, power level control, mode selector switch, indicator lights and start switch for the upper microwave oven.

To maintain a pleasing appearance of such a control panel and to avoid confusing the user, it is necessary to locate certain components near the related components. Symmetry is also of importance in order to obtain proper balance. Oftentimes the available space behind the control panel does not match the spacing that is dictated by the aesthetics of the control panel. This is what motivated the discovery of the present invention.

The mounting position of a push button switch behind a control panel is dictated by the available space in relation to the other components. Frequently, the control panel is provided with secondary push buttons of decorative size, shape and appearance for operating the hidden push button switch.

A prior art patent showing a push button switch with an enlarged secondary push button is the Abernethy et al U.S. Pat. No. 3,916,150. This patent teaches a push button switch having an enlarged secondary push button in combination with a guide post mounted parallel to the first push button so the secondary push button will not cause the first push button to jam.

The principal object of the present invention is to provide a control assembly with a push button switch having a secondary push button supported in a control panel in a manner offset from the first push button, so the secondary push button may be operated at any side without causing the push button switch to jam.

A further object of the present invention is to provide a push button switch assembly of the class described with a fulcrum means for the secondary push button to provide smooth operation.

A further object of the present invention is to provide a push button switch assembly of the class described with a spacer spring biasing the secondary push button to provide smooth operation.

SUMMARY OF THE INVENTION

The present invention, in accordance with one form thereof, relates to a control assembly having a push button switch supported from a mounting means and a control panel positioned over the switch and spaced therefrom. A secondary push button is supported in an opening in the control panel in a position that is out of alignment with the first push button. The secondary push button includes flange means to prevent this button from passing out through the opening. The flange means has a side extension on the side nearest the first push button to provide a fulcrum means with respect to the cover plate and insure enough distance of travel as well as smooth operation.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENTS

Figure 1:
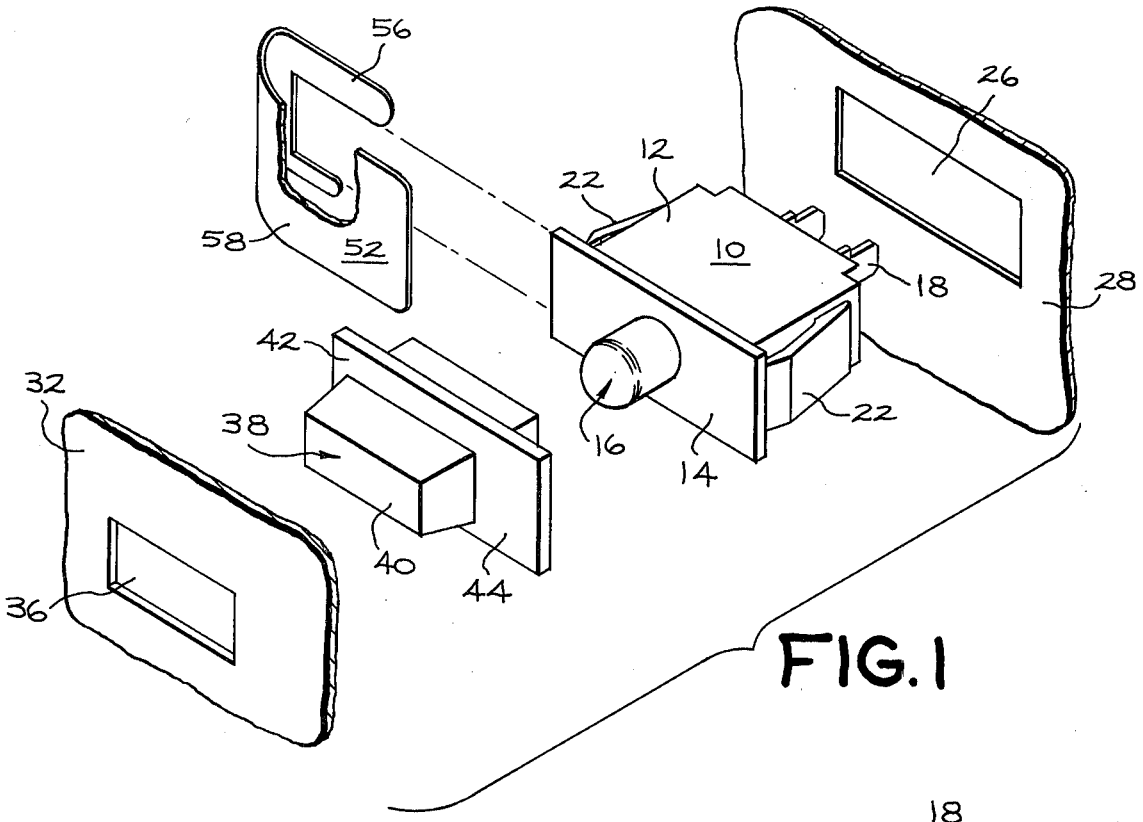
FIG. 1 is an exploded fragmentary perspective view of a control assembly comprising the present invention showing a push button switch in front of its mounting plate, a secondary push button in front of the switch, a cantilever spring adapted to fit between the switch and the secondary push button, and a control panel for receiving the secondary push button.

Turning now to a consideration of the drawings, and in particular to FIG. 1, there is shown an electric push button switch 10 of standard design having an insulating housing 12 with a front mounting strap 14, a spring-biased push button 16, electrical terminals 18 on the back side of the switch housing and a pair of resilient mounting fingers 22 on the opposite sides of the housing, as is conventional in this art. The push button switch 10 is supported in an opening 26 in a mounting plate 28. The switch 10 is assembled in the opening 26 by pushing the switch, as shown in FIG. 1, through the opening so the fingers 22 will be compressed until the mounting strap 14 engages the mounting plate 28 which frees the fingers 22 to return to their normal position where they will engage and interlock with the inner surface of the mounting plate 28, as is shown in FIG. 2.

A control panel 32 is positioned in front of the push button switch 10 and spaced outwardly therefrom. This panel 32 has a rectangular opening 36 for receiving a secondary push button 38. As is clear from FIG. 2, the centerline of the secondary push button 38 is offset to the left from the centerline of the first push button 16. This misalignment is not due to a buildup of manufacturing tolerances but is designed into the control assembly.

The secondary push button 38 has an elongated rectangular face 40 and a transverse planar flange 42 about its midportion to serve as a stop means to engage the back side of the control panel 32 and prevent the secondary push button 38 from passing out through the opening 36. The secondary push button 38 would work well if it were depressed by the user at the right side of the button in FIG. 2 for this force would be in a line near the centerline of the push button switch 16.

Figure 2:
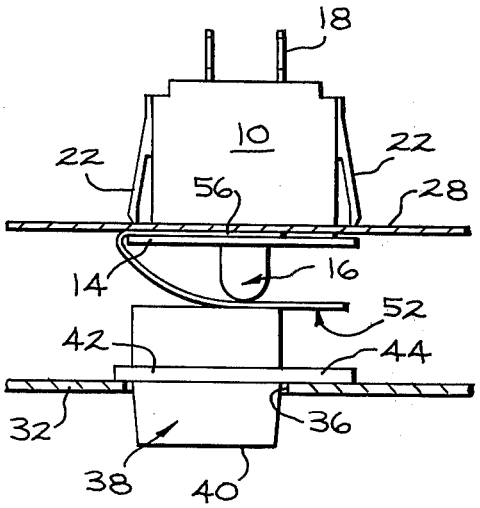
FIG. 2 is a cross-sectional plan view of the control assembly of FIG. 1 showing the normal at-rest position of the secondary push button with its flange extension, as well as the nature of the folded-over cantilever spring bearing against the inner end of the secondary push button.
Figure 3:
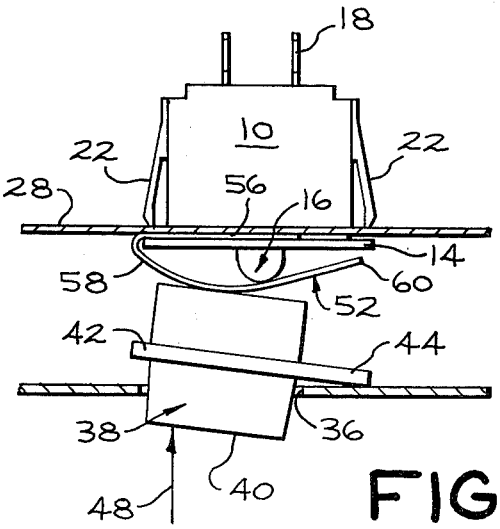
FIG. 3 is a cross-sectional plan view similar to that of FIG. 2 showing the operation of the flange extension and the cantilever spring when the secondary push button is acted upon by the user exerting a pushing force at the side that is remote from the centerline of the first push button.

If the switch-actuating force were applied at the left side of the button 38 in FIG. 2, the button might become jammed except for the presence of a flange extension 44 at the short side of the rectangular face 40 that is nearest the centerline of the push button 16. As best seen in FIG. 3, this flange extension 44 serves as a fulcrum means with relation to the control panel 32 to provide a long radius of movement for the secondary push button 38 when this button is pushed at its left side, as shown by the arrow 48 in FIG. 3. This also gives the button 38 a longer travel or throw than if the flange 42 were narrow and symmetrical about the button. This travel or throw is important to insure the actuation of the push button switch 10.

Another improvement is the use of a cantilever spring 52, sometimes called spacer spring, that is supported from the mounting plate 28 to bear against the inner end of the secondary push button 38 and urge it to seat the flange 42 against the control panel 32, as seen in FIG. 2. This spring 52 takes care of any dimensional tolerance buildup and prevents the secondary push button 38 from rattling when outside environmental vibrations are set up, such as by motor or fan operations.

Moreover, the secondary push button 38 is preferably a hollow molded plastic part with thin walls. The cantilever spring 52 is of wide width to cover the opening in the back end of the hollow button 38 to give a good bearing surface between the first push button 16 and the secondary push button 38.

The cantilever spring 52 is of folded-over configuration having a flat bifurcated end 56 which is adapted to slip onto the side of the switch housing 12 and behind the mounting strap 14, as is seen in FIG. 2. Extending from the bifurcated end 56 is a cantilever blade 58 of slightly curved configuration which is sandwiched between the two push buttons 16 and 38. The tip 60 of the blade 58 is elongated to extend beyond the secondary push button. The reason for this elongation is to provide a stop or limit means to engage the mounting strap 14 of the switch 10, as is best seen in FIG. 3. This protects the switch mechanism and also limits the travel of the secondary push button 38 to prevent it from slipping through the opening 36 of the control panel. The end of the blade portion opposite the tip is located adjacent the side of the secondary push button 38, remote from the centerline of the push button 16, so that the stiffest portion of the spring is adjacent the side of the secondary push button 38, that is remote from the flange extension 44.

Modifications of this invention will occur to those skilled in this art; therefore, it is to be understood that this invention is not limited to the particular embodiments disclosed, but that it is intended to cover all modifications which are within the true spirit and scope of this invention as claimed.

What is claimed is:

1. In a control assembly comprising an electrical push button switch supported from a mounting means, said switch including a primary push button and a secondary push button, a control panel positioned over the switch and spaced therefrom, an opening formed in the control panel offset from the centerline of the primary push button of the switch, said secondary push button being positioned in the opening of the control panel so that it is out of alignment with the primary push button of the switch, a flange formed on the secondary push button to overlie the said opening on the inner side of the control panel and prevent the push button from passing out through the opening, the said flange having an extension on the side of the secondary push button which is nearest the primary push button, said flange extension serving as a fulcrum means with respect to the control panel, said flange extension being of sufficient length to provide supplementary lever action to set the switch, thereby preventing jamming when the secondary push button is depressed adjacent the side which is remote from the flange extension and further including a cantilever spring sandwiched between the two push buttons with one end of the spring fixedly mounted to the push button switch on a side remote from the flange extension so that the stiffest portion of the spring is adjacent the side of the secondary push button that is remote from the flange extension, the other end being a resilient spring blade of sufficient width to provide a bearing surface between the primary and secondary push buttons, said spring blade having an elongated distal end, and wherein said assembly further includes stop means engageable by said distal end to limit the amount of depression of the secondary push button thereby protecting the switch and retaining the secondary push button in the control panel opening.

2. In a control assembly comprising an electric push button switch supported from a mounting means, said switch including a primary push button and a secondary push button, a control panel positioned over the switch and spaced therefrom, an opening formed in the control panel offset from the centerline of the primary push button of the switch, the secondary push button being positioned in the opening, limit means on the secondary push button to prevent this button from passing out through the opening, a cantilever spring sandwiched between the primary and secondary push buttons such that the stiffest portion of the spring is located adjacent the edge of the secondary push button remote from the centerline of the primary push button, with one end of said spring being fixed to the mounting means, and the other end being a resilient spring blade biased outwardly against the inner side of the secondary push button, said blade being of sufficient width to provide a bearing surface between the primary and secondary push button, said blade having an elongated distal end, and said assembly further including stop means engageable by said distal end to limit the amount of depression of the secondary push button, thereby protecting the switch and retaining the secondary push button in the control panel opening.

* * * * *